United States Patent [19]

Knollmueller

[11] Patent Number: 4,744,221

[45] Date of Patent: May 17, 1988

[54] ZEOLITE BASED ARSINE STORAGE AND DELIVERY SYSTEM

[75] Inventor: Karl O. Knollmueller, Hamden, Conn.

[73] Assignee: Olin Corporation, Cheshire, Conn.

[21] Appl. No.: 68,486

[22] Filed: Jun. 29, 1987

[51] Int. Cl.[4] ..... F17C 11/00

[52] U.S. Cl. ..... 62/48; 55/74

[58] Field of Search ..... 62/48, 55.5; 55/74, 55/75

[56] References Cited

U.S. PATENT DOCUMENTS

| | | | |
|---|---|---|---|
| 1,375,819 | 4/1921 | Blumenberg, Jr. | 204/101 |
| 3,335,550 | 8/1967 | Stern | 62/55.5 |
| 3,982,912 | 9/1976 | Yatsurugi et al. | 55/35 |
| 4,165,569 | 8/1979 | Mackay | 62/48 |
| 4,178,224 | 12/1979 | Porter | 204/237 |
| 4,535,072 | 8/1985 | Kitayama et al. | 55/74 |

FOREIGN PATENT DOCUMENTS

| | | |
|---|---|---|
| 1116537 | 1/1982 | Canada . |
| 150599 | 9/1981 | German Democratic Rep. . |
| 57-91719 | 6/1982 | Japan . |

OTHER PUBLICATIONS

Johnson, F. M. G., *J. of American Chemical Society,* vol. 34, "The Dissociation Pressures of Phosphonium Bromide and Iodide", 1912, pp. 877–880.

Smith, A. and R. P. Calvert, *J. of American Chemical Society,* vol. 36, "The Dissociation Pressures of Ammonium— and Tetramethylammonium Halides and of Phosphonium Iodide and Phosphorus Pentachloride", 1914, pp. 1363–1382.

Chem. Abst. 86: 31373d; "Dynamics of the Thorough Drying of Gaseous Inorganic Hydrides by Granulated Zeolite NaA", Morozov, V. I., Efremov, A. A., Zel'venskii, Ya. D. (USSR). *Tr. Mosk. Khim.—Technol., Inst.,* 1975, 85, 82–83 (Russ.).

Yusa, A., Y. Yatsurugi, and T. Takaishi, *J. of the Electrochemical Society, vol. 122 No. 7, "Ultrahigh Purification of Silane for Semiconductor Silicon", Jul., 1976, pp. 1700–1705.*

Chem. Abst. 91: 93728k: "Thorough Drying of Volatile Inorganic Hydrides with Synthetic Zeolites", Morozov, V. I., Efremov, A. A., Zel'venskii, Ya., D., Potepalov, V. P., (USSR), *Poluch. Anal. Veshchestv Osoboi Chist.,* (Dokl. Vses. Konf.) 5th 1976 (publ. 1973), 63–72 (Russ.).

Chemical Abst. 99: 29657x, "Fabrication of Ultrahigh—Purity Silicon Single Crystals:, Itoh, D., Kawamoto S. Miki, S., Namba, I., Yatsurugi, Y., (Komatsu Electron. Met. Co. Ltd., Kiratsuka, Japan 254), *Mater. Res. Soc. Symp. Process,* 1983, 16 (Nucl. Radiat. Detect. Mater.) 39–45 (Eng.).

*Primary Examiner*—Ronald C. Capossela

*Attorney, Agent, or Firm*—Dale Lynn Carlson

[57] ABSTRACT

An arsine storage and delivery system, and, more specifically, an improved system for storing arsine on zeolite while providing delivery of the arsine as needed.

9 Claims, No Drawings

ZEOLITE BASED ARSINE STORAGE AND DELIVERY SYSTEM

FIELD OF THE INVENTION

The present invention relates generally to arsine and, more specifically, to an improved system for storing arsine on zeolite while providing delivery of the arsine as needed.

BACKGROUND OF THE INVENTION

Arsine is known to be extremely toxic to humans, much more toxic than arsenic oxide which is commonly used as a rat poison.

In spite of its toxicity, arsine is widely used in the semi-conductor industry as an arsenic source for the fabrication of semi-conductors (such as gallium-arsenide wafers) and as a gas dopant for silicon devices using CVD-reactors and diffusion ovens, molecular beam epitaxy depositors or ion implanters.

Typically, arsine is conventionally supplied for these commercial applications by means of cylinders containing either pure arsine or arsine in admixture with a carrier gas such as hydrogen or helium. Leaks of these arsine-containing cylinders are potentially very hazardous, particularly during transportation and shipment of these cylinders when back-up scrubbing or other safety systems may not be in place. Under these circumstances, venting or rupture of the cylinder is potentially catastrophic.

The use of zeolites to scrub waste gases for the removal of toxic and/or corrosive materials in the waste gas is known. By way of illustration, Canadian Pat. No. 1,116,537, assigned to Hoechst A.-G., discloses a process for recovering phosphine from a waste gas mixture also containing hydrogen, nitrogen, and/or non-polar lower hydrocarbons by contacting the waste gas with a zeolite to adsorb the phosphine. The zeolite is subsequently heated to desorb and recover the phosphine. This Canadian patent does not disclose or suggest the use of zeolites to recover arsine from waste gas. In view of differing physical and chemical properties of phosphine and arsine (e.g., arsine is much more labile), any prediction of the effect of zeolites on arsine in waste gas (to say nothing of non-waste gas) would be the subject of mere speculation based upon a reading of the Canadian patent.

In view of the above, new systems that provide improved, relatively safe, storage of arsine in a non-waste (feed) gas, together with delivery of the arsine as needed would be highly desired, particularly in the electronics industry.

SUMMARY OF THE INVENTION

In one aspect, the present invention relates to a method of storing and subsequently delivering arsine which comprises the steps of:

(a) contacting arsine at a temperature of between about −30° C. and about +30° C. with a zeolite having a pore size of between about 5 and about 15 angstroms to provide arsine-adsorbed zeolite suitable to be stored, and (b) heating said arsine-adsorbed zeolite to an elevated temperature of no greater than 175° C. for a time sufficient to release at least a portion of said adsorbed arsine to provide free arsine.

In another aspect, the present invention relates to a container enclosing an arsine-adsorbed zeolite, said container being equipped with an internal or external heating means for controllably heating said zeolite to an elevated temperature to provide a controlled release of free arsine from said arsine-adsorbed zeolite.

These and other aspects will become apparent upon reading the following detailed description of the invention.

DETAILED DESCRIPTION OF THE INVENTION

The arsine storage and delivery system of the present invention provides a relatively safe mechanism for storing this material prior to use, as well as a controlled release of arsine as needed during use thereof. By way of illustration, it is envisioned in accordance with the present invention that tanks holding arsine-adsorbed zeolite can be safely shipped or transported by truck or rail to an electronics plant that uses arsine. At the plant, free arsine is controllably released by heating the arsine-adsorbed zeolite to an elevated temperature for a time sufficient to release it from the zeolite. Although the system of the present invention is expected to be particularly useful in the electronics industry, the system is expected to be useful wherever the relatively safe storage and delivery of arsine is desired.

Although not wishing to be bound by any particular theory, the relative safety associated with the arsine adsorbed on zeolite in accordance with the system of the present invention is attributable to the relatively low vapor pressure of pure arsine, in equilibrium with adsorbed arsine at ambient temperatures, as well as the relatively low partial pressure of arsine gas in a carrier gas(es) (if used). For example, at temperatures below about 80° C., the partial pressure of arsine in the container system of the present invention is generally less than one atmosphere. On this basis, in the event of a small leak in the container, the arsine will generally tend to stay in the container, thus minimizing or avoiding environmental or safety problems.

Typically, the arsine at a temperature of between about −30° C. and about +30° C. (preferably between about −30° C. and about 0° C., more preferably between about −30° C. and about −10° C.) is contacted with the zeolite to cause the arsine to adsorb onto the zeolite. The contact time can vary over a wide range, ranging from a few seconds or less to several minutes or more.

When use of the adsorbed arsine is desired, the zeolite containing adsorbed arsine is heated via internal or external heating means (such as a heating coil or tape overwrapping or inside the container) to an elevated temperature for a time sufficient to cause desorption. As the temperature of the zeolite is gradually raised above ambient temperature, the adsorbed arsine is gradually released, particularly in the temperature range of about 80° C. to about 175° C. Thus, by controlling the rate of elevation of temperature of the zeolite, the rate of release of free arsine is suitably controlled. The preferred elevated temperature range has an upper limit of about 125° C., more preferably 110° C., of the arsine to minimize side reactions or decomposition reactions of the arsine in the zeolite.

Although not wishing to be limited in any way, it has been found in accordance with the present invention that about 200 grams or more of arsine can be adsorbed per kilogram of zeolite. For example, a ZEOLITE 13x has been found to adsorb 220 grams of arsine per kilogram of zeolite, whereas a ZEOLITE 5A was found to adsorb 190 grams per kilogram. Desorbing at 110° C. has been found to produce a 0.2 weight percent elemental arsenic residue based on the weight of the zeolite per desorption cycle which, after the fourth cycle of using the arsine for desorption, typically decreases the adsorption efficiency of the zeolite to an arsine adsorption capacity of about 160 grams per kilogram of zeolite.

In an alternate embodiment, arsine can be desorbed from the zeolite at temperatures as low as 20° C. or lower and into a cold bath, such as liquid nitrogen, by condensing the arsine into the bath. In this embodiment, the temperature differential between the zeolite and the cold bath is theorized by the present inventor to be the driving force for the arsine desorption.

In accordance with the present invention, the arsine is employed in either pure form or preferably in admixture with a carrier gas such as hydrogen, argon, nitrogen, helium, or mixtures thereof. If a carrier gas is used, the amount of arsine in the container is suitably between traces and 25 weight percent or more based on the total weight of the arsine/carrier gas mixture. There can be a slight adsorption of these carrier gas(es) onto the zeolite. For example, if arsine adsorption is effected at minus 12° C. in the presence of hydrogen, a small amount of hydrogen weakly adsorbs to the zeolite and, in turn, desorbs when the temperature of the zeolite is increased to room temperature.

The containers holding arsine adsorbed onto zeolite in accordance with the present invention are usefully maintained at atmospheric, sub-atmospheric or super-atmospheric pressure, as desired. Even if pressurized to a super-atmospheric pressure, the advantages of the instant zeolite-containing container over the containers of the prior art are clear. Upon rupture, prior art pressurized arsine vessels will rapidly vent to the atmosphere and require back-up safety devices such as scrubbers or holding tanks to avoid a potential safety and/or environmental problem. Upon rupture of a pressurized zeolite-containing container of the present invention, only a small amount of already free arsine might escape whereas the zeolite-bound arsine would generally not escape into the atmosphere.

Useful zeolites would include those having a pore size of between about 5 and about 15 angstroms. Preferably, the zeolite has a pore size of between about 10 and about 15 angstroms, more preferably between about 12 and about 15 angstroms. Typically, K-A grade, A grade or Na-A grade commercial zeolites can be used in the system of the invention. As an illustrative example, a useful 10 angstrom-type zeolite would include one having an Al to Si ratio of 0.6–0.9 to 1 and preferably also has an Na to Ca ratio of 15–20 to 1. Useful commercial zeolites include ZEOLITE 13x and ZEOLITE 5A, products of the Linde Division of Union Carbide Corporation. The ZEOLITE 5A has an average pore size of about 5 angstroms, whereas the ZEOLITE 13x has an average pore size of about 13 with a pore size range generally between about 10 and about 15 angstroms.

It is preferred that the arsine employed in the system of the present invention be essentially water-free since water competes with arsine for between about 5 and about 15 angstroms, thereby diminishing the arsine adsorption capacity of the water-containing zeolite as compared to water-free zeolite. A suitable method of rendering arsine free of water is to contact the arsine with a 3 to 4 angstrom zeolite since this smaller pore size zeolite will selectively adsorb water from a water-containing arsine composition. In addition, the zeolite itself can be rendered water-free prior to the arsine adsorption step by heating the zeolite to about 430° C. in a vacuum or in the presence of a dry gas stream.

Arsine can be generated by any of the well-known methods. The arsine utilized in the illustrative examples given below was generated by electrolysis of a sodium arsenite/phosphoric acid electrolyte with copper cathode and Ru-plated Ti anode. Following an electrolytic generation method as generally outlined in U.S. Pat. No. 4,178,224, incorporated herein by reference, with minor modifications to fit a laboratory scale, as well as the replacement of the ultra-pure copper cathode of the referenced '224 patent with a silver-plated copper ring cathode and the use of a ruthenium-plated titanium anode. In accordance with our method, a glass cell of 650 ml cathode and 100 ml anode volume was constructed which could be operated at 20–24 V and 1.6 A current. The arsine was swept by a carrier gas ($N_2$, Ar and $H_2$ were used) from the cathode compartment into a U tube cooled to −78° C. Most water and a trace higher arsenic hydride were held back there. The remaining water was removed in a tube 12" long and 1" diameter which was filled with dehydrated ZEOLITE 5A. The arsine needed for all experiments described in the examples following was generated with this equipment.

The generation of free arsine by heating the zeolite containing adsorbed arsine is suitably done in a controlled fashion to provide a desired constant flow rate of free arsine in compositions containing a carrier gas. Temperature ramping in accordance with a precalculated temperature profile is suitably employed, preferably in conjunction with in-line arsine monitoring in the arsine/carrier gas mixture. In-line measurement of the arsine in such a gas mixture can be accomplished using a thermoconductivity detector with thermistor sensors to continuously monitor the evolving gas stream via VPC-chromatograpy. Alternately, optical means can be used to measure the arsine in the evolving gas based upon the steep optical absorption thereof in the wavelength range of between 218 and 230 nanometers. This optical method is described more fully in EXAMPLE 10 below.

The following examples are intended to illustrate, but in no way limit the scope of, the present invention.

EXAMPLE 1

Determination of Arsine Adsorption Capacity of Zeolite

The zeolite to be tested (ZEOLITE 5A or ZEOLITE 13x described hereinabove) was heated for four hours in a vacuum at 0.2 mm Hg during which time the temperature was raised to 430° C. and held there for one hour. A glove bag filled with dry nitrogen was used to transfer this dehydrated zeolite into the absorption vessel. This consisted of a 12 cm long SS tube with a 0.9 cm interior diameter. Body and screw cap were equipped with gas inlet and outlet tubes of ⅛" stainless steel with the needle shutoff valves on both sides attached. The capacity of zeolite was 5.3±0.15 g. The zeolite charge weight was determined after the experiments by weighing the residual zeolite on an analytical balance. Arsenic formed during the experiments was determined by analyzing the zeolite and subtracting the weights. Next, the zeolite in the absorption vessel was cooled to −12° C. and arsine gas in the carrier used was passed through the cell until no more was absorbed. (Test with silver nitrate paper).

The system was attached to a dry carrier gas cylinder via a needle valve and flow meter. The off gases were passed into a scrubber which consisted in a gas wash bottle containing bromine and water; the initial heterogenous phase was stirred with a magnetic bar. In the bromine water, the liberated arsine was oxidized to arsenic acid, while bromine was reduced to hydrobromic acid. As the latter built up during the reaction, the solubility of the bromine needed for further reaction increased.

During the desorption, the temperature of the zeolite bed was raised from ambient to 200° C. over a four to six hour time period. The bulk of the arsine was liberated between 60° C. and 120° C. Tests showed that at the end of the run, no more arsine was detectable in the off gases.

Excess bromine was next reduced with sulfur dioxide and the arsenic content of the absorber solution determined either by standard analysis (volumetric) or by instrumental methods. The remaining zeolite was analyzed for residual arsenic.

Following the above procedures with either argon or hydrogen as the carrier gas, the arsine capacity was calculated from the analytical data:

ZEOLITE 13x: Capacity 210±10 g/Kg. Residual as content after 1 experiment: 0.2±0.5%.

ZEOLITE 5A: Capacity 190±10 g/Kg. Residual as content after 1 experiment: 0.25±0.05%.

EXAMPLES 2-8

Determination of the Gas Composition Resulting From Isothermal Desorption of Arsine The apparatus described in EXAMPLE 1 was used with the following modifications: The inlet valve was attached to a gas manifold with a nanometer, feeding the carrier gas. The needle valve and flow meter were placed after the exit of the absorber tube with the zeolite. In this way, a systems pressure of typically 15 psig could be maintained. The connection tube to the arsine scrubber was fitted with a septum sampler port through which during the experiments, 200 to 1000 microliter samples of the gas mixture could be withdrawn and later analyzed. Because the flow meter would now give only approximate results due to the ever-changing gas compositions, a water displacement bottle was attached to the exit of the arsine scrubber (bromine water wash bottle). By monitoring the water volume displaced with time, the flow rate of the carrier gas portion of the gas could be measured and any drift corrected.

The gas mixture sampled was injected into HYPO VIALS TM, (a product of The Pierce Company) of 5 ml capacity containing 1 ml of 0~0.1N $KI_3$ in 1 ml saturated $NaHCO_3$.

This solution oxidized arsine to arsenate, which was later determined by a colorimetric method, based on the reduction of an arsenato-molybdate complex with hydrazine sulfate.

For these experiments, generally four charge-discharge cycles on one charge of zeolite were done, before the zeolite was analyzed for residual As°.

The arsine concentrations were plotted against ml carrier gas passed. In each case, the arsine concentration Y after passage of X ml carrier gas can be expressed by the equation:

$$Y = A + B \ln X \quad \text{(Eq. I)}$$

The constants A and B depend on the initial charge state and temperature of the system.

The results of several experiments are summarized in TABLE I. The arsine concentration in mg $AsH_3$/ml carrier gas ($H_2$) for flows up to 600 ml can be calculated by the coefficients A and B used in Equation 1.

TABLE I

Isothermal Desorption of Arsine From ZEOLITE 13x With $H_2$ at 15 Psig Systems Pressure

| Experiment No. | Zeolite Wt. g | T °C. | Flow Rate ml/min | Capacity g/Kg | Coefficients A | Coefficients B |
|---|---|---|---|---|---|---|
| 2 | 5.4226 | 85 | 1.72 | 199 | 2.8572 | -0.3837 |
| 3 | 5.4226 | 85 | 2.88 | 192 | 2.8469 | -0.3770 |
| 4 | 5.4226 | 75 | 2.85 | 191 | 2.6088 | -0.3400 |
| 5 | 5.4226 | 65 | 2.91 | 161 | 1.6895 | -0.2050 |
| 6 | 5.2270 | 75 | 1.75 | 213 | 2.2164 | -0.2893 |
| 7 | 5.2270 | 75 | 1.75 | 174 | 2.8159 | -0.3832 |
| 8 | 5.2270 | 75 | 1.75 | 159 | 2.6336 | -0.3550 |

The arsenic residuals after EXAMPLES 5 and 8 were 1.3±0.2 percent in both cases. The spread is caused by inhomogenity of the arsenic distribution in the residue.

EXAMPLE 9

System Temperature Elevation To Effect Constant Rate of Arsine Desorption

This example shows temperature increase during desorption as a means of obtaining a constant gas composition.

The experimental set-up was as described in EXAMPLES 2-8, with a zeolite charge of 5.277 g, saturated with arsine. The systems pressure was set with hydrogen 15 psig. Throughout the experiment, a carrier gas flow of 1.73+/−0.2 ml/min was maintained. Thus, during seven hours, 730 ml $H_2$ (atmospheric pressure) was passed through the system. During this time, the temperature of the system was gradually raised from 61° to 82° C. Every 30-45 minutes, samples were withdrawn for analysis of the gas composition.

While initially a higher than targeted gas composition emerged (initial loading level was not known), the gas composition stayed at 15+/−1.5 percent $AsH_3$ during the last 4.5 hours of the experiment.

EXAMPLE 10

Temperature Ramping and Instrumental Arsine Composition Check for Obtaining a Constant Composition Gas Mixture The experiment was repeated with a fresh ZEOLITE 13x charge (5.350 g). On the apparatus the following modifications were made: Before the gas entered the arsine scrubber system ($Br_2+H_2O$), a quartz gas cell of 1 cm path length was switched into a 3-Stopcock manifold. This arrangement allowed the off gas to pass through the cell before entering the scrubber. During optical measurements, the gas passed directly into the scrubber. For control and calibration purposes, the optical cell also was equipped with a septum port through which the gas samples were taken for analysis. Prior to the actual experiment, an isothermal desorption as described in Experiments 2-8 was done to calibrate the optical absorption versus arsine content of the mixture. Calibration curves for the wavelengths 219 to 226 nm (in 1 nm steps) were established.

The actual desorption was done with hydrogen as carrier at a systems pressure of 15 psig and a 1.8 ml/min flow rate. Periodically, the cell was placed into the ultraviolet spectrophotometer and readings were taken. From previously determined calibration curves at 221, 222, and 223 nm, the arsine concentration could be directly read and drifts quickly compensated by adjustment of the temperature.

During the first 436 minutes in which 780 ml carrier gas (atmospheric pressure) was passed through, the temperature had to be raised from 42° to 79° C. to maintain an arsine concentration of 15+/−1 percent. The experiment was resumed the next day after cooling to room temperature overnight, then 510 ml carrier gas was used during 290 minutes, during which time the temperature was raised from 80° to 100° C. Again, the arsine concentration stayed at 15±1 percent in the gas leaving the storage system.

What is claimed is:

1. A method of storing and subsequently delivering arsine which comprises the steps of:

(a) contacting arsine at a temperature of between about −30° C. and about +30° C. with a zeolite having a pore size of between about 5 and about 15 angstroms to provide arsine-adsorbed zeolite suitable to be stored, and (b) heating said arsine-adsorbed zeolite to an elevated temperature of no greater than about 175° C. for a time sufficient to release at least a portion of said adsorbed arsine to provide free arsine.

2. The method of claim 1 wherein said pore size is between about 10 and about 15 angstroms.

3. The method of claim 1 wherein said pore size is between about 12 and about 15 angstroms.

4. The method of claim 1 wherein said zeolite has an aluminum to silicon ratio of between 0.6 and 0.9 to 1.

5. The method of claim 1 wherein said temperature of step (a) is between about −30° C. and about 0° C.

6. The method of claim 1 wherein said temperature of step (a) is between about −30° C. and about −10° C.

7. The method of claim 1 wherein said elevated temperature of step (b) is no greater than about 125° C.

8. The method of claim 1 wherein said elevated temperature of step (b) is no greater than about 110° C.

9. The method of claim 1 wherein said time ranges between a few seconds and several hours.

* * * * *